US011891198B1

(12) United States Patent
Ochs

(10) Patent No.: US 11,891,198 B1
(45) Date of Patent: Feb. 6, 2024

(54) ROLL-FORMED CONTAINERS FOR SHIPPING

(71) Applicant: Amazon Technologies, Inc., Seattle, WA (US)

(72) Inventor: Garett Ochs, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 2 days.

(21) Appl. No.: 17/592,786

(22) Filed: Feb. 4, 2022

Related U.S. Application Data

(63) Continuation of application No. 16/871,767, filed on May 11, 2020, now Pat. No. 11,267,594.

(51) Int. Cl.
*B65B 11/26* (2006.01)
*B65B 5/02* (2006.01)
*B65D 5/02* (2006.01)

(52) U.S. Cl.
CPC ..... *B65B 11/26* (2013.01); *B65B 5/02* (2013.01); *B65D 5/0218* (2013.01)

(58) Field of Classification Search
CPC ..... B65B 11/26; B65B 5/02; B65D 5/0218
See application file for complete search history.

(56) References Cited

U.S. PATENT DOCUMENTS

| | | | | |
|---|---|---|---|---|
| 4,308,904 | A * | 1/1982 | Martin | A61J 1/10 604/408 |
| 5,275,332 | A * | 1/1994 | Heuberger | B65D 5/062 229/117.34 |
| 5,671,883 | A * | 9/1997 | Philips | B65D 5/54 229/236 |
| 6,364,199 | B1 * | 4/2002 | Rose | B65D 5/0005 229/101 |
| 2010/0102112 | A1 * | 4/2010 | Ouillette | B65D 5/606 493/162 |
| 2017/0320615 | A1 * | 11/2017 | Izquierdo | B65D 5/3635 |
| 2019/0077527 | A1 * | 3/2019 | De Pietri Tonelli | B65B 9/2049 |

* cited by examiner

*Primary Examiner* — Andrew M Tecco
*Assistant Examiner* — Nicholas E Igbokwe
(74) *Attorney, Agent, or Firm* — Eversheds Sutherland (US) LLP

(57) ABSTRACT

Systems, methods, and computer-readable media are disclosed for roll-formed containers for shipping. In one embodiment, an example container for an item may include a rectangular sheet of formable material, the rectangular sheet having a first crease line, a second crease line separated from the second crease line by a distance, a first crease pattern disposed adjacent to the first crease line, and a second crease pattern disposed adjacent to the second crease line. The container may include a sealant disposed about three sides of the rectangular sheet.

9 Claims, 8 Drawing Sheets

ROLL-FORMED CONTAINERS FOR SHIPPING

CROSS-REFERENCE TO RELATED APPLICATION

This application is a continuation of U.S. Ser. No. 16/871,767, filed May 11, 2020, the entirety of which is incorporated by reference.

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that manual efforts can be redirected to different tasks. Moreover, in some instances, single items may be packed in containers for shipment. However, such items may be of different shapes and sizes. Accordingly, custom sized containers for shipping may be desired.

Figure 1:
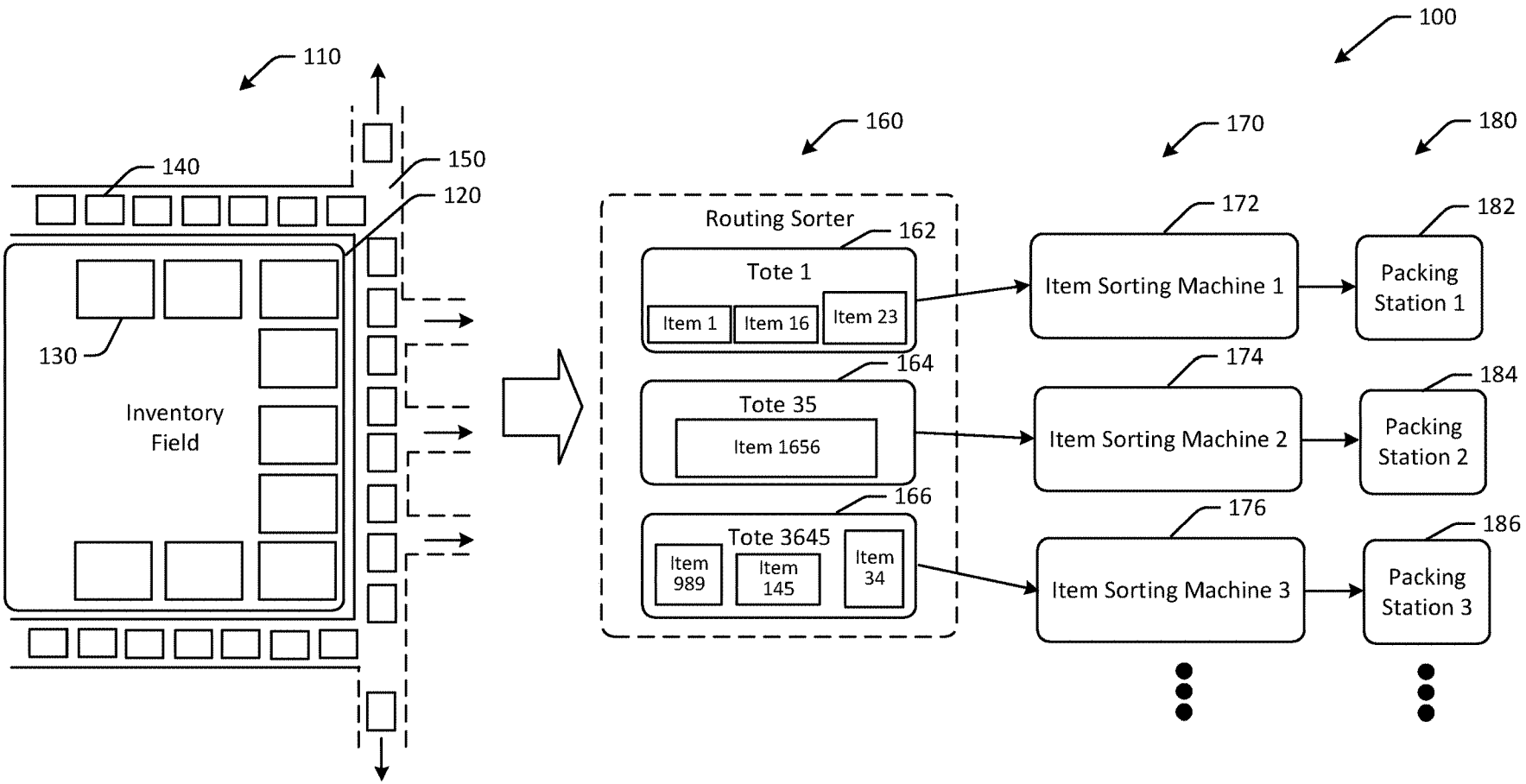
FIG. 1 is a hybrid schematic illustration of an example use case for roll-formed containers for shipping and an example process flow in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. In some instances, the product(s) may be packed and shipped from the fulfillment center. However, the process of obtaining the product(s), packing the product(s), and shipping the product(s) may be complicated due to the amount of inventory, the number of orders to process, the size of the fulfillment center, and/or other factors. In addition, a portion of the fulfillment center designated for packing or shipping may be different than the portion of the fulfillment center designated for holding product inventory. As a result, transportation of products in an order may be time consuming. In addition, a number of different types of containers may be used to pack items into for shipping. For example, container types may include boxes, bags, flexible containers (e.g., paper mailers, bubble wrap mailers, etc.) and/or other types of containers. Some containers may be have fixed sizes or dimensions, and may therefore be larger than an item that is packed inside, resulting in the use of bubbles, packing paper, or other fillers to reduce a likelihood of damage to the item during transit. In addition, certain containers may be formed of non-recyclable materials, such as certain types of plastic. Accordingly, custom sized or right-sized containers that are made of recyclable may be desired so as to not only reduce environmental impact, but also to reduce waste and packaging material consumption due to custom sized containers for items, thereby removing the need for fillers and avoiding containers that are too big relative to the size of the item(s) in the container.

Embodiments of the disclosure include methods and systems for roll-formed containers for shipping that may improve packing quality (e.g., items may not move within the container as the container is custom sized around the item, etc.), and reduce environmental impact by providing a recyclable package that can be recycled after delivery. Certain embodiments include custom container formation equipment that can be used to produce containers that are sized based at least in part on dimensions of an item to be packed inside the container. The containers may be formed of a single sheet of roll-formed material, such as a paper-based material (e.g., unpadded cardboard, single-sided or double-sided corrugate, a non-Gaussian material, etc.) that is formed around the item to be packed. The item may be placed onto a portion of the recyclable material and the container may be formed using one or more rollers and folders that can be used to form a number of different container configurations, including configurations with inward-facing gussets, outward-facing gussets, bent sidewalls, round sidewalls, flat sidewalls, and so forth, along with different types of seals. Containers may be output at a rate of up to or greater than 2,000 units per hour. Some embodiments include camera assemblies or other sensor assemblies that can be used to determine item dimensions and placement. To facilitate scalability, certain embodiments may produce a number of containers at substantially the same time, or during an overlapping timeframe, as discussed with respect to FIG. 2. Some embodiments include optimized process flows for processing of orders at fulfillment centers, as well as process flows or methods to increase speed of consolidating products in a single-item or multi-item order as a result of improved speed in placing items into containers and removing items from containers. As a result, throughput of fulfillment centers may be improved, and/or logistics of fulfillment center operations may be less complicated.

Some embodiments may include systems and methods for continuous roll-forming and filling of custom sized packages using recyclable or non-recyclable packaging material. Some embodiments may be formed of materials such as sheets or other continuous spans of material. Materials may include laminated materials, thermal transitioning materials (e.g., materials that change various properties when heated, etc.), plastic materials, polymer materials, paper-based materials, composite materials, and/or other materials that may be roll-fed into a system. Certain embodiments include dynamically indexable and/or repositionable rolling dies to crease, perforate, and/or score a repeated triangular or diamond pattern along the material at a specified spacing to form containers of different dimensions. A height to width ratio of the triangular or diamond patterns (or any other suitable geometry pattern, including linear patterns, circular patterns, oval patterns, etc.) may also be dynamically indexable and/or adjustable to further define the fully formed dimensions of the package.

Referring to FIG. 1, an example use case 100 for roll-formed containers for shipping and an example process flow is depicted in accordance with one or more embodiments of the disclosure. Although discussed in the context of online orders, other embodiments may be directed to any suitable use case where objects are packed into containers, such as instances where items for single item orders that are picked from inventory and placed into flexible containers for shipment, and so forth.

In FIG. 1, a fulfillment center may include an inventory field 110, a routing sorter 160, one or more item sorting machines 170, and one or more packing stations 180. The inventory field 110 may be include a storage platform, or a portion of the fulfillment center at which products picked from product inventory are placed. Robots may be used to pick products from inventory and to deliver to the robotic storage platform in some instances, while in other instances, manual labor or a combination thereof may be used to pick products. The picking process at the robotic storage platform may include locating a product in an order, obtaining the product, and sending the product to a robotic storage platform, such as via a conveyor belt. In the illustrated embodiment, products at the robotic storage platform may be placed in a container, such as a tote.

The inventory field 110 may include multiple items that are in inventory. The items may be used to fulfill orders. The inventory field 110 may be a robotic field in some instances. One or more picking stations 130 may be positioned along a perimeter 120 of the inventory field 110. The picking stations 130 may be manually operated or may include robotic components, or a combination thereof. In some instances, picking of items from the inventory field 110 may be completed by robots, where the items are delivered to the picking stations 130 after being retrieved from the inventory field 110. Any number of picking stations 130 may be included, and the picking stations 130 may be located in a different position than that illustrated in FIG. 1.

One or more conveyors 150 may be disposed about the inventory field 110. For example, conveyors 150 may be disposed along the perimeter 120 of the inventory field 110. The conveyors 150 may run adjacent to the picking stations 130 in some embodiments. Any suitable conveyor configuration may be used. In the illustrated example, the conveyors 150 may include belts or rollers that run alongside the picking stations 130 and include one or more paths to one or more routing sorters.

The conveyors 150 may be used to transport one or more totes 140. For example, as totes 140 move along the conveyors 150, items may be moved from the picking stations 130 into respective totes 140. The totes 140 may be associated with particular item sorting machines, and may be moved using the conveyors 150 to a routing sorter 160.

The routing sorter 160 may be configured to route, divert, or otherwise guide certain totes to an item sorting machine. The routing sorter 160 may include any combination of ramps, slides, rollers, arms, guides, and/or other components to route totes to a particular item sorting machine. At the routing sorter 160, totes including products that have been picked may be routed to the appropriate or designated item sorting machine. For example, the routing sorter 160 may determine an identifier associated with the tote, and may determine an item sorting machine associated with the tote using the identifier. The routing sorter 160 may route or direct the tote to the appropriate item sorting machine.

A number of item sorting machines 170 may be coupled to the routing sorter 160. For example, a first item sorting machine 172, a second item sorting machine 174, a third item sorting machine 176, and so forth may be coupled to the routing sorter 160. The routing sorter 160 may guide totes to the item sorting machines to which they are assigned. For example, a first tote 162 may include item 1, item 16, and item 23, and may be assigned to the first item sorting machine 172. The routing sorter 160 may therefore route the first tote 162 to the first item sorting machine 172 for sortation of the respective items. A second tote 164 may include item 1656, and may be assigned to the second item sorting machine 174. The routing sorter 160 may therefore route the second tote 164 to the second item sorting machine 174 for sortation of the item. A third tote 166 may include item 989, item 145, and item 34, and may be assigned to the third item sorting machine 176. The routing sorter 160 may therefore route the third tote 166 to the third item sorting machine 176 for sortation of the respective items.

Some or all of the item sorting machines may be associated with one or more packing stations 180 that may be used to pack items into a shipment when a single-item or multi-item order is complete. For example, the first item sorting machine 172 may be coupled to a first packing station 182, the second item sorting machine 174 may be coupled to a second packing station 184, the third item sorting machine 176 may be coupled to a third packing station 186, and so forth. The item sorting machines may be configured to receive items from totes that have one or more, or multiple, items. The number of totes and/or the number of items associated with respective item sorting machines may be balanced, and multiple totes may be routed to the first item sorting machine 172 and the second item sorting machine 174 at the same time.

Some of the packing stations may be configured to pack items for single-item orders into containers for shipment, such as custom-sized roll-formed containers, instead of pre-sized containers with fixed dimensions. In one example embodiments, container systems as described herein may be packing stations for single items orders, such that single items are placed into custom sized roll-formed containers and transported downstream for shipment.

At any of the stages of the example fulfillment process of FIG. 1 where handling of objects is used, such as to pick items from inventory, place items in totes, remove items from totes, place items into bins, remove items from bins, place items into boxes for shipping, and so forth, robotic may be used. As a result, manual effort can be redirected to other tasks.

Embodiments of the disclosure include roll-formed containers for shipping. Certain embodiments may reduce waste and improve shipment quality by providing custom sized containers, and may improve processing speed and/or throughput of fulfillment centers. Certain embodiments may improve performance of mechanical equipment for packing, sortation, and/or consolidation of items. While described in the context of online orders, aspects of this disclosure are more broadly applicable to other forms of object handling.

Example embodiments of the disclosure provide a number of technical features or technical effects. For example, in accordance with example embodiments of the disclosure, certain embodiments of the disclosure may improve packing quality, reduce a likelihood of item or container damage, and improve processing speed, throughput, and/or efficiency of fulfillment centers. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of the embodiments disclosed herein are also within the scope of this disclosure. The above-described embodiments and additional and/or alternative embodiments of the disclosure will be described in detail hereinafter through reference to the accompanying drawings.

Illustrative Embodiments and Use Cases

Figure 2:
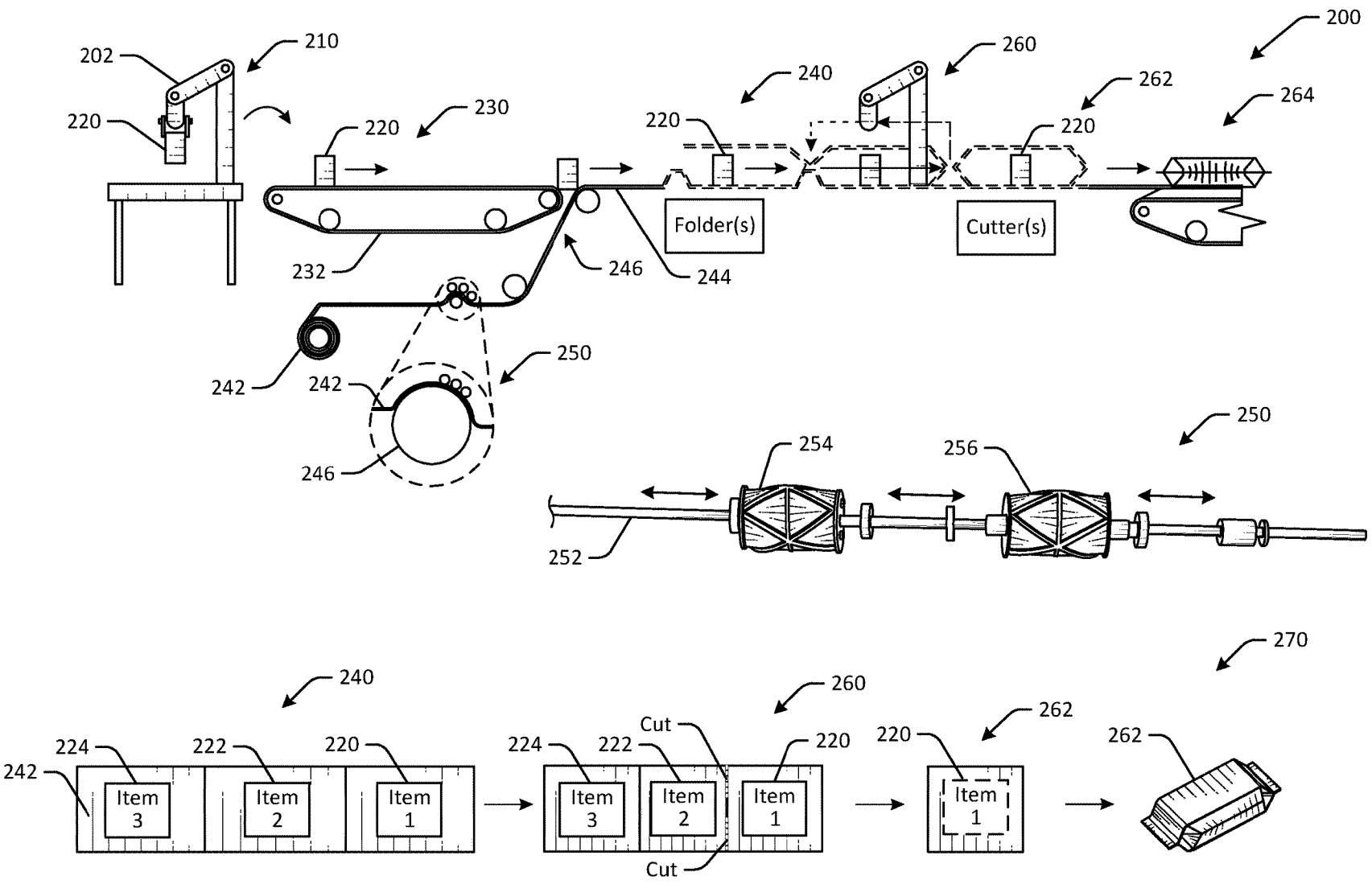
FIG. 2 is a schematic illustration of an example roll-formed container generation system and a schematic process flow in accordance with one or more embodiments of the disclosure.

FIG. 2 is a schematic illustration of an example custom sized roll-formed container generation system 200 and a schematic process flow 270 in accordance with one or more embodiments of the disclosure. Other embodiments may include additional or fewer components. The illustration of FIG. 2 may not be to scale, and may not be illustrated to scale with respect to other figures. The custom sized roll-formed container generation system 200 illustrated in FIG. 2 is for illustrative purposes only, and other embodiments may have a different configuration. The custom sized roll-formed container generation system 200 may be used at, for example, any of the packing stations discussed with respect to FIG. 1.

In FIG. 2, the custom sized roll-formed container generation system 200 may be configured to retrieve items for packing, and to pack the items into custom sized roll-formed containers. An item 220 may be input at the custom sized roll-formed container generation system 200 for packing. One or more robotic arms 202 may be used to place the item 220 onto a first conveyor 232 for an induction process 230 into the custom sized roll-formed container generation system 200. During the induction process 230, one or more cameras or other sensors, such as LIDAR sensors, depth sensors, and so forth may be used to determine one or more dimensions of the item 220. For example, a first sensor may be used to capture one or more top-down images of the item 220, and a second sensor may be used to capture one or more side-view images of the item 220. The sensor(s) may generate data that is used to determine one or more dimensions of the item 220. For example, the sensor(s) may be depth cameras or depth sensors used to generate data points that can be processed to determine one or more dimensions of the item 220. The item 220 may flow along the first conveyor 232 onto a portion of packaging material 242. The packaging material 242 may be a roll-formed packaging material, such as corrugate, or a different packaging material, such as a non-Gaussian packaging material, an unpadded packaging material, or the like. In some embodiments, any material that can be creased or bent can be used. Although a single roll of the packaging material 242 is depicted, other embodiments may include additional rolls of packaging material, and some or all of the packaging materials may have different widths, such as widths of 27 inches and 35 inches to provide added flexibility in packaging items of different dimensions. The packaging material 242 may flow along a second conveyor 244 that moves at the same speed, or substantially the same speed, as the first conveyor 232.

The item 220 may therefore flow seamlessly from the first conveyor 232 onto the packaging material 242 on the second conveyor 244. On the second conveyor 244, the item 220 may be imaged during a positioning confirmation process 240. During the positioning confirmation process 240, a position of the item 220 on the packaging material 242 may be determined using one or more sensors. The position of the item 220 may be compared to a predetermined boundary to determine whether the item 220 is sufficiently positioned at or near a center of the packaging material 242. If a positioning adjustment is needed, a second robotic arm may be used to adjust or reposition the item 220 on the packaging material 242.

Based at least in part on the dimensions of the item 220, a length of packaging material to be used for packaging the item 220 may be determined. The length of packaging material may be adjusted by dispensing the determined amount of packaging material 242 from the roll of packaging material.

In addition to the length of packaging material, a width between fold lines that are to be made on the packaging material 242 may be determined. The width between fold lines may correspond to a width of the item 220. The fold lines may be creases, score lines, perforations, or other features that facilitate bending of the packaging material 242. In some embodiments, fold lines may be embossed, serrated, perforated, texturized, or otherwise deformed. To impart the fold lines onto the packaging material 242, one or more adjustable rollers or dies 250 may be used. As the packaging material 242 is fed forward, in addition to roll forming, partial width slitting may occur as the packaging material 242 contacts the rollers or dies 250. The slits may be cut, for example, with one or more rotary blades, with one cut on either side of the material, where the slitting process is performed while the packaging material 242 is stationary (e.g., between roll forming processes, etc.). The dies may be adjustable in one or more lateral direction to increase or decrease separation between a first die 254 and a second die 256 of the adjustable die 250. The dies may move along a shaft 252. The dies may have any suitable pattern, such as triangular patterns, diamond patterns, circular patterns, linear patterns, or other types of patterns. In some embodiments, the dies may be heated, which may increase the number of different types of packaging materials that can be used with the custom sized roll-formed container generation system 200. In some embodiments, the dies 250 may be used on the packaging material 242 before the item 220 is placed onto the packaging material 242, whereas in other embodiments, individual dies may be used to create the fold lines on the packaging material 242 after the item is positioned on the packaging material 242. In some embodiments, to effect the fold lines on the packaging material 242, a single roller 246 may be used to press the packaging material 242 against one or more rollers or dies 250 that may be statically positioned. In other embodiments, the rollers or dies 250 may be movable. More than one set of rollers and/or dies may be used to impart the fold lines onto the packaging material. Fold lines are discussed in detail with respect to FIG. 4. As the packaging material 242 is unwound and flows toward the second conveyor 244, hot melt or another adhesive may be applied at region 246. A shipping label may be applied at an opposite side at the region 246 and may be verified using a scanner or other hardware.

Figure 4:
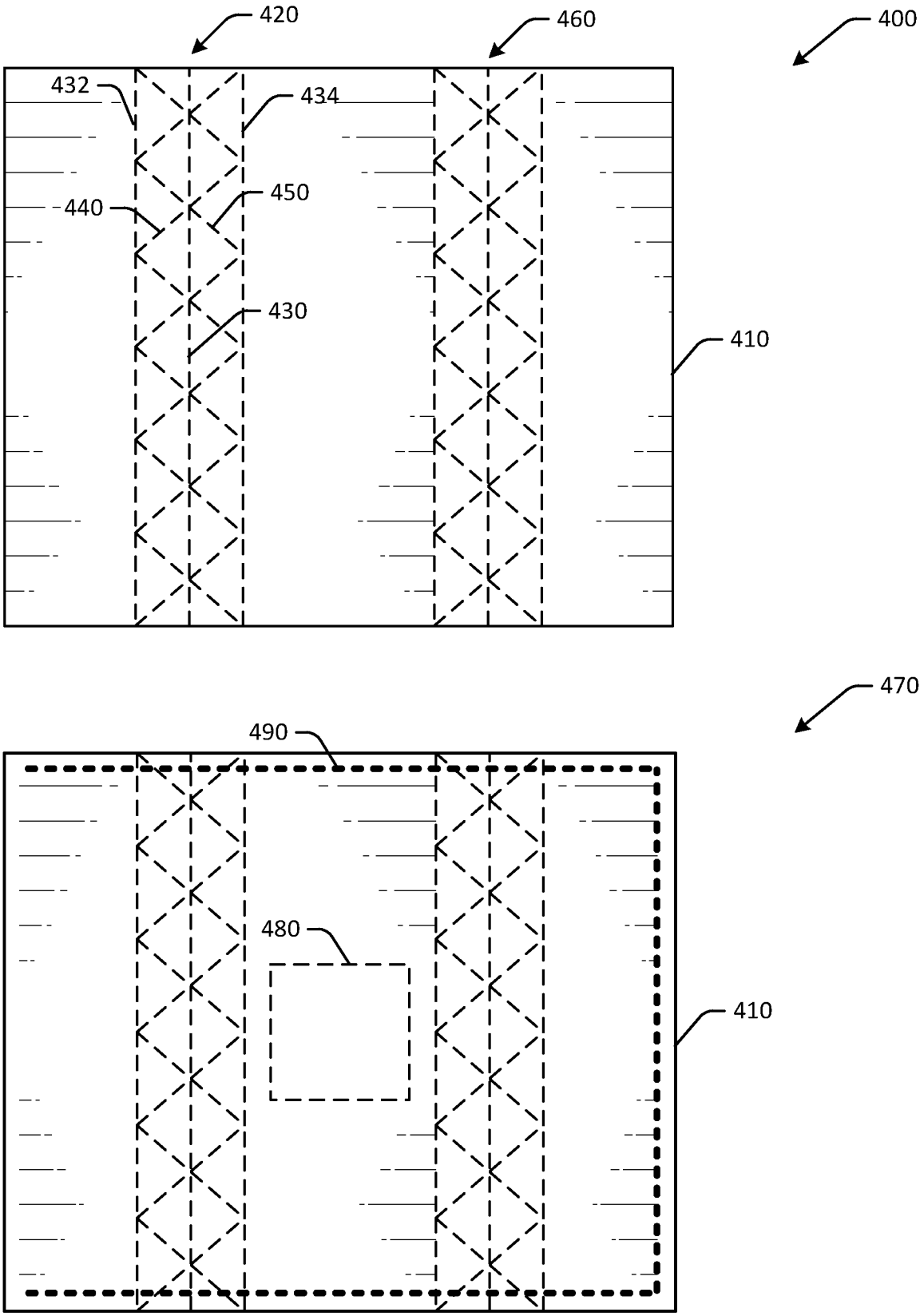
FIGS. 4-5 are schematic illustrations of a roll-formed container in various stages of formation in accordance with one or more embodiments of the disclosure.

After positioning of the item 220 on the packaging material 242 is confirmed to be acceptable, or after the item is repositioned and then confirmed to be within the predetermined boundary, an adhesive or sealant, such as a hot melt glue, pressure-sensitive adhesive, tape, glue, thermal sealing component, or other adhesive or sealant may be applied about one or more edges and/or the width of the packaging material. For example, in some embodiments, adhesive may be applied about three sides of the packaging material 242, as depicted in FIG. 4. In other embodiments, adhesive may be applied about more or less than three sides of the packaging material 242. To apply the adhesive, the adhesive may be sprayed, applied in a beaded or spiral pattern, or otherwise distributed along one or more surfaces of the packaging material 242. In some embodiments, before the item 220 is placed on the packaging material 242, a portion of the adhesive may be applied. The length of adhesive may correspond to the determined length of packaging material 242 to be used for packaging of the item 220.

After the adhesive is applied, the process may continue to a cutting and folding station 260 at which a first cut may be made partially across a width of the packaging material 242, and a second cut may be made partially across the width of the packaging material 242, leaving a center strip of packaging material that connects the packaging material to the adjacent portion of packaging material. In some embodiments, the cutting and folding station 260 may be a walking jaw and may create two parallel seals at the same time or substantially the same time (e.g., consecutive seals, etc.). In an example, one seal may be at the end of a package, and another seal may be the front end of an adjacent package. The cutting and folding station 260 may include an integrated cutting/severing blade, which may be used to cut or trim the unglued area in between parallel seals. As the walking jaw or cutting and folding station 260 slides along the packaging material 242, space between seals may be trimmed as the seals are formed.

Once the cuts are made in the packaging material 242, one or more folders may be used to fold a first side of the packaging material over the item 220, and a second side of the packaging material 242 over the first side of the packaging material. An amount of overlap between the first side and the second side may be adjusted so as to form a package that custom fits the item 220.

After the sides are folded, the sides may be pressed to cause the adhesive to bind the package edges and the overlap together to form a sealed package 262 about the item 220. In some embodiments, the folders may be used to form inward-facing or outward-facing gussets depending on a type of package that to be formed, as discussed with respect to FIG. 7. A final cut may be made to separate the sealed package 262 from the adjacent packaging material portion. The sealed package 262 may be pushed onto or otherwise fed onto a takeaway container 264 for downstream processing of the sealed package 262. As a sealed package is severed from the packaging material 242, it can be conveyed downstream for further processing.

As illustrated in the schematic process flow 270 in FIG. 2, more than one item may be disposed on the packaging material 242 at a time to increase throughput of the custom sized roll-formed container generation system 200. For example, the item 220 may be a first item, a second item 222 may be disposed on an adjacent portion of the packaging material 242, and a third item 22 may be disposed on an adjacent portion of the packaging material 242. As the cuts are made partially across the width of the packaging material, the package being formed may remain connected to the adjacent packaging material portion, such that control over the package being formed is retained. Although illustrated as two separate cuts made inwards from both sides of the packaging material, in other embodiments, a single cut may be made, or a portion of the packaging material other than the center, such as a side strip, may be used to retain a connection between the adjacent portions of the packaging material. In one example, the packaging material may have a width of 12 inches, where the first cut is four inches, and the second cut is four inches (leaving a four inch strip connecting the portions of packaging material). The remaining strip may be cut before the package is sent downstream.

The custom sized roll-formed container generation system 200 may therefore be an item packing station that includes a number of components. For example, the custom sized roll-formed container generation system 200 may include the first conveyor 232 configured to transport the item 220 for packing, and a second conveyor 242 configured to transport the packaging material 242. The second conveyor 244 may be disposed adjacent to the first conveyor 232, and both the first conveyor 232 and the second conveyor 244 may be configured to move at substantially the same speed or at the same speed, so as to facilitate handoff between the respective first conveyor 232 and the second conveyor 244. The custom sized roll-formed container generation system 200 may include a number of cameras or other sensors that may be used along various points and/or positions. For example, the custom sized roll-formed container generation system 200 may include a first sensor system configured to image the item 220. The first sensor system may include one or more cameras or other sensors and may be configured to generate data used to determine dimensions of the item 220. A second sensor system may be configured to image the item 220 on the packaging material 242 to determine whether positioning of the item 220 falls within a predetermined boundary. In an embodiment, the custom sized roll-formed container generation system 200 may include two sensors used to determine item dimensions, one sensor to determine positioning of the item prior to handoff of the item, and another sensor to determine correct positioning of the item on the packaging material.

The custom sized roll-formed container generation system 200 may include a set of one or more rollers or dies 250 configured to crease or otherwise impart formations on the packaging material 242. The custom sized roll-formed container generation system 200 may include a controller configured to determine, using the first sensor system, a first dimension of the item 220, such as a width or a height, and to determine a length of packaging material 242 to use for packing the item 220, where the length is determined using the first dimension. The controller may be configured to cause a first crease line and a second crease line to be formed on a surface of the packaging material 242 using the set of one or more rollers or dies 250. The controller may be configured to cause a first side of the packaging material to be folded over the item 220, and to cause a second side of the packaging material to be folded over the first side of the packaging material to form an overlapping portion. The width of the overlapping portion may be adjusted based at least in part on the size of the item 220. The controller may be configured to cause ends of the packaging material to be pressed to form a package, where the item is disposed in the package.

Figure 3:
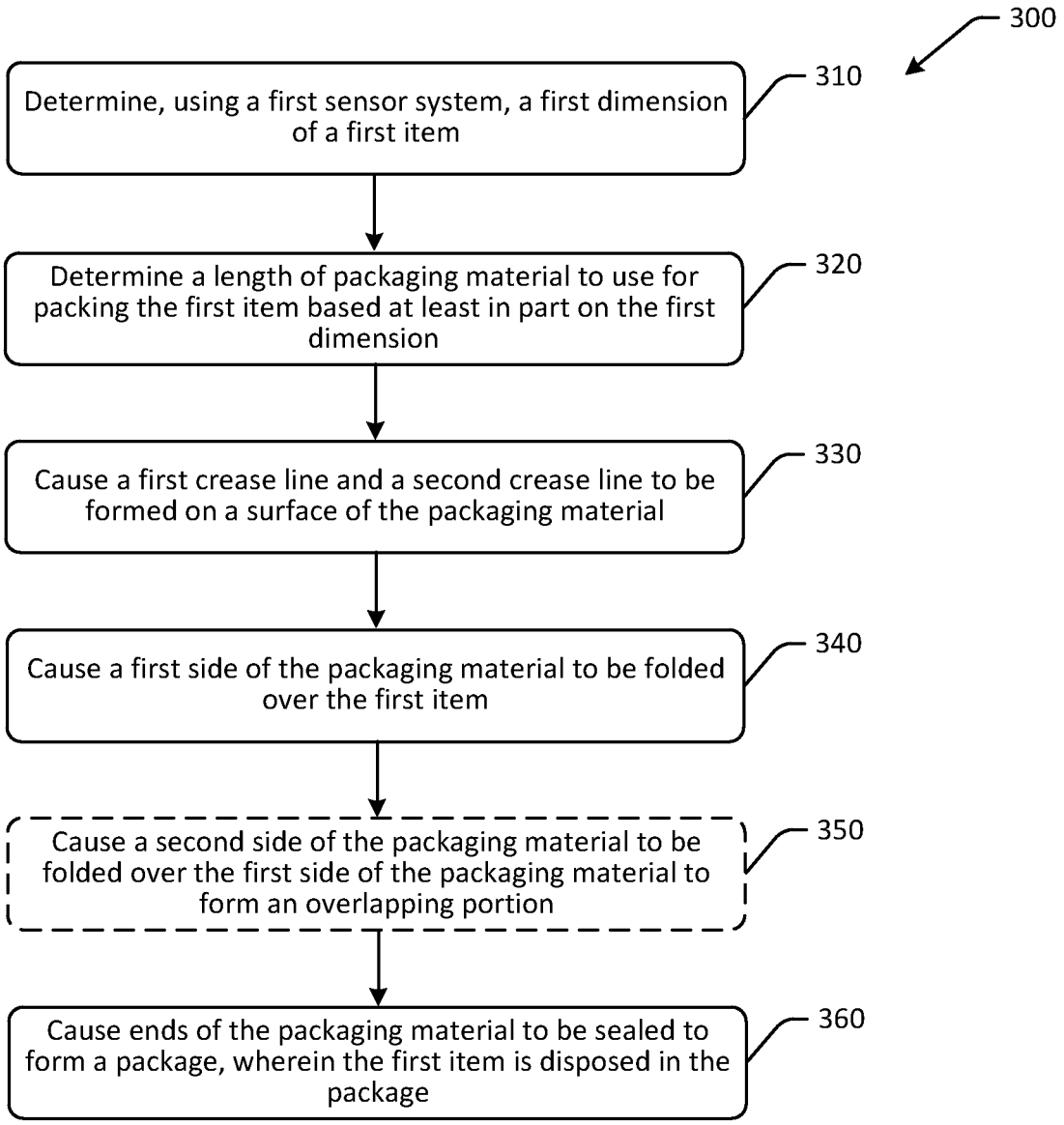
FIG. 3 is a schematic illustration of an example process flow for generating roll-formed containers in various views in accordance with one or more embodiments of the disclosure.

FIG. 3 is a schematic illustration of an example process flow 300 for generating custom sized roll-formed containers in various views in accordance with one or more embodiments of the disclosure. Other embodiments may include additional or fewer operations. The process flow 300 may be performed by one or more computer systems, such as the controller discussed with respect to FIG. 2, and one or more operations may be performed at least partially concurrently and/or in a different order than that depicted in the example of FIG. 3.

At block 310, a first sensor system may be used to determine a first dimension of a first item for packing into a custom sized container. For example, the controller may cause the first item to be transported to the packaging material via a conveyor moving at a first speed, wherein the packaging material is moving at the first speed when the first item flows onto the packaging material. The first sensor system may include one or more cameras, such as depth cameras or other sensors, in different positions. In one embodiment, a sensor may be coupled to a robotic arm and used to image various angles of the first item to determine the first dimension. The first dimension may be a height, length, or width of the first item. In some embodiments, more than one sensor may be used to determine one or more dimensions of the first item. Data generated using the respective sensors may be used to determine one or more dimensions of the item.

At block 320, a length of packaging material to use for packing the first item may be determined based at least in part on the first dimension. For example, based at least in part on a length of the first item, a length of packaging material may be determined that corresponds to the length of the item. In another example, the width or height of the first item may be used to determine the length of packaging material. The determined length may be used to determine how much packaging material is to be unrolled or otherwise used to package the first item. For example, the controller may cause the packaging material to advance from a roll of packaging material until the length of packaging material to use for packing the first item is advanced.

At block 330, a first crease line and a second crease line may be caused to be formed on a surface of the packaging material. For example, the controller may cause one or more rollers or dies to contact the packaging material and to impart crease lines onto the packaging material. Crease lines may be fold lines, score lines, perforations, or other lines that form depressions in a surface of the packaging material, and may facilitate bending of the packaging material. Depending on the type of packaging material, the packaging material may not crease, and when unsealed, may return to a substantially flat shape. The rollers or dies may be adjustable to form crease lines with various separation distances, so as to accommodate items of different sizes. In some instances, the rollers or dies may be heated to be effective with an increased number of packaging materials. In some embodiments, in addition to crease lines, tessellations or other patterns may also be formed adjacent to the crease lines to form flexible sidewalls of the package. An adhesive may be applied about one or more portions of the packaging material before or after the crease lines are formed. For example, the controller may cause, using one or more adjustable rollers, a first crease pattern to be formed adjacent to the first crease line on the surface of the packaging material, and, using the one or more adjustable rollers, a second crease pattern to be formed adjacent to the second crease line on the surface of the packaging material.

At block 340, a first side of the packaging material may be caused to be folded over the first item. For example, the controller may cause one or more cutting assemblies to form a first cut along a width of the packaging material, and a first side of the packaging material may be caused to be folded over a top of the first item using one or more folders. Before the first side is folded, the controller may determine, using a second sensor system, whether the first item is positioned in a first position on the packaging material that exceeds a predetermined boundary. If the boundary is exceeded, the first item may be repositioned using a robotic arm or other hardware, or a notification for manual intervention may be generated. For example, the controller may cause the first item to be repositioned from the first position to a second position within the predetermined boundary.

At optional block 350, a second side of the packaging material may be caused to be folded over the first side of the packaging material to form an overlapping portion. For example, the controller may cause one or more cutting assemblies to form a second cut along a width of the packaging material, and a second side of the packaging material may be caused to be folded over the first side of the packaging material to form an overlapping portion using one or more folders. The amount of overlap may be adjusted based on one or more dimensions of the first item, thereby forming a custom sized container. A height of the package may be adjustable by adjusting an amount of overlap of the overlapping portion. In some embodiments, to form certain types of packages, such as flat mailers or envelopes, there may not be an overlapping portion for the package. Instead, a first side may be folded over the other, and the second side may not be folded.

At block 360, ends of the packaging material may be caused to be sealed to form a package, wherein the first item is disposed in the package. One or more pressers or other equipment may be caused, by the controller, to add pressure to the ends and/or the overlapping portion of the packaging material to seal the package. The remaining portion of the packaging material may be cut and the sealed package may be transferred for downstream processing. Sealing may include sewing, pressing, folding, or otherwise closing the package.

Figure 5:
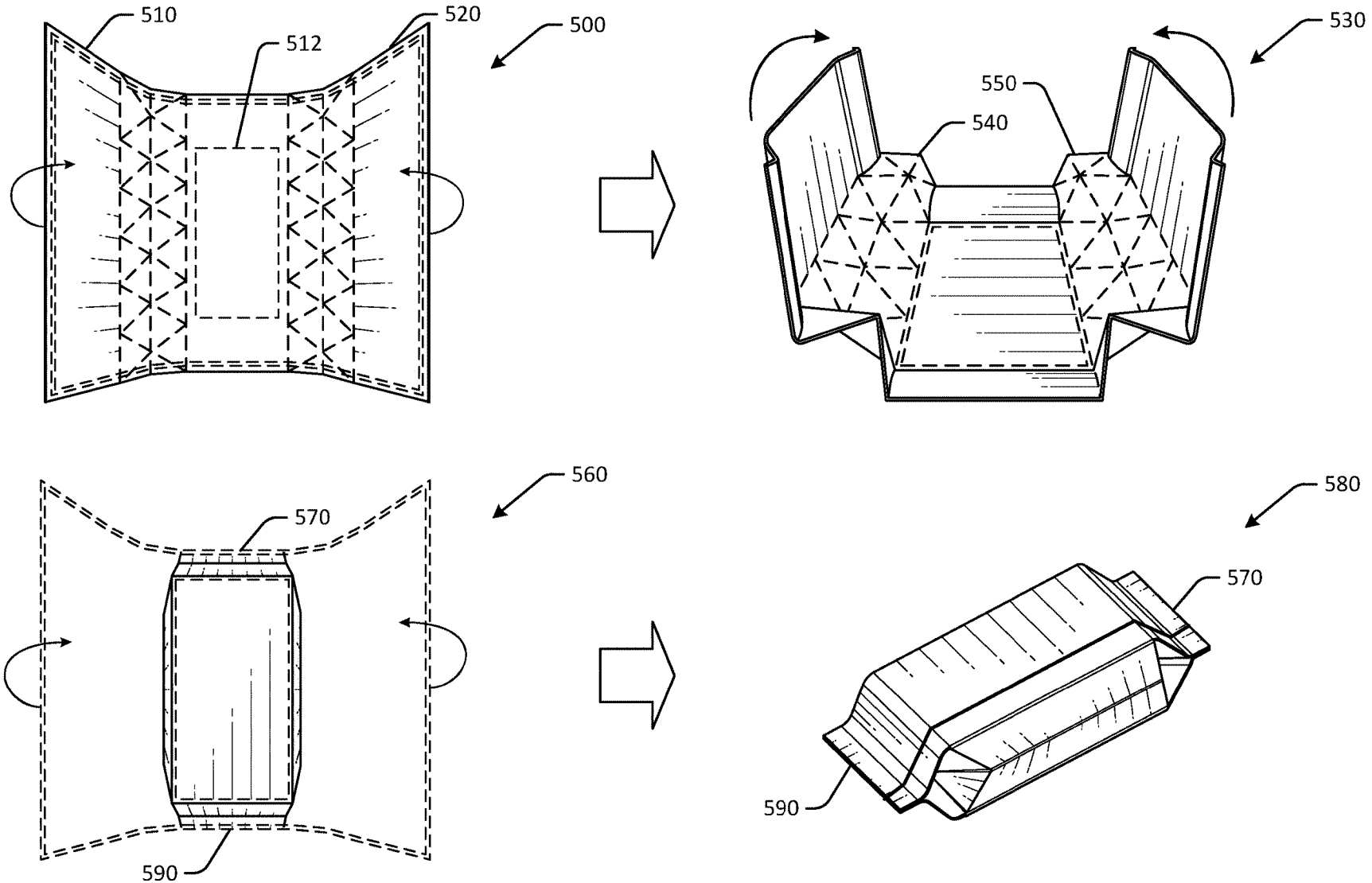

FIGS. 4-5 are schematic illustrations of a custom sized roll-formed container in various stages of formation in accordance with one or more embodiments of the disclosure. Other embodiments may include additional or fewer components. The illustration of FIG. 4 may not be to scale, and may not be illustrated to scale with respect to other figures. The sample fold lines or crease patterns depicted in the examples of FIGS. 4-5 are for illustrative purposes only. Other embodiments may have different lines, patterns, dimensions, or other configurations.

In FIG. 4, a sheet of packaging material 410 is depicted in a top view during a creasing process 400. The sheet of packaging material 410 may be connected to a roll of packaging material. The sheet of packaging material may have a fixed width and variable length, as determined by an amount of material unrolled from the roll of packaging material. The packaging material may be an unpadded material, such as single-sided corrugate. Other embodiments may have different non-Gaussian materials. In some embodiments, the packaging material may be heated to increase compliance.

A number of crease lines or patterns may be formed on an upper surface of the sheet of packaging material 410. For example, a first set of crease lines 420 and a second set of crease lines 460 may be formed on the upper surface of the sheet of packaging material 410. The first set of crease lines 420 and the second set of crease lines 460 may be separated by a distance that is equal to or slightly greater than a width of the item to be packed in the container. The first set of crease lines 420 may include one or more crease lines formed, for example, using one or more rollers. In some embodiments, the first set of crease lines 420 and/or the second set of crease lines 460 may include a single line (e.g., so as to form a flat package, etc.), whereas in other embodiments, the first set of crease lines 420 and/or the second set of crease lines 460 may include more than one line, so as to form sidewalls of a container. In some embodiments, the first set of crease lines 420 may include transverse crease lines, such as in the illustrated embodiment, where the transverse crease lines can form a pattern that may increase flexibility of the sidewalls of the package. For example, the first set of crease lines 420 may include a central crease line 430, a first parallel crease line 432, and a second parallel crease line 434, where the separation between the first parallel crease line 432 and the second parallel crease line 434 may correspond to a height of the item to be packed (e.g., the separation may be equal to or greater than the height of the item, etc.). Transverse lines 440, 450 may be used to form patterns, such as the triangular or diamond pattern depicted in FIG. 4 (e.g., two triangular patterns may be arranged to form a diamond pattern, etc) Similarly, the second set of crease lines 460 may include transverse crease lines, such as in the illustrated embodiment, where the transverse crease lines can form a pattern that may increase flexibility of the sidewalls of the package. In some embodiments, the first set of crease lines 420 and the second set of crease lines 460 may have the same dimensions, patterns, and so forth, whereas in other embodiments, the first set of crease lines 420 and the second set of crease lines 460 may have different dimensions, patterns, and so forth, so as to accommodate items of different shapes and geometries, such as wedge-shaped items.

Accordingly, the item for packing may be measured using one or more depth sensing sensors. A length of packaging material for packing the item may be determined and unrolled. The sheet of packaging material 410 may be creased by adjustable rolling dies (e.g., the dies may be separated to separate the distance between the first set of crease lines 420 and the second set of crease lines 460, and/or to separate the distance between individual crease lines of the first set of crease lines 432, 430, 434, etc.). To impart the crease lines, one or more computer systems in communication with the item packing system may be configured to cause, using a set of one or more rollers, a first diamond crease pattern to be formed adjacent to the first crease line on the surface of the packaging material 410, and cause, using the same set or a different set of one or more rollers, a second diamond crease pattern to be formed adjacent to the second crease line on the surface of the packaging material 410.

After the crease lines are formed, an adhesive may be applied during an adhesive application process 470. The adhesive may be applied as a hot melt glue that is sprayed, beaded, or otherwise applied along one or more sides of the sheet of the packaging material 410. For example, the adhesive 490 may be applied along sides of the sheet of packaging material 410 to form a C-pattern. Other embodiments may have adhesive disposed in a different pattern about or more, such as all, sides of the sheet of packaging material. A label 480 may be applied to a lower surface of the sheet of packaging material 410. The label 480 may include destination information for the package. Some embodiments may not include adhesive. For example, a heat sealable material may be heat sealed instead of using adhesive, or a different material may be sewn, and so forth.

In FIG. 5, the sheet of packaging material 410 is depicted in various folding stages as the package is formed. At a first instance 500, a first side 510 of the sheet of packaging material may be folded over an item 512 to be packed. After the first side 510 is folded, a second side 520 may be folded over the first side 510. In some embodiments, the second side 520 may be folded over the item before the first side 510 is folded over the item. The sides may be folded one at a time. Before the sides are folded, a first cut and a second cut may be made across a width of the packaging material to separate the sides from the roll of packaging material for folding. For example, the computer system may cause a first cut to be formed along the width of the packaging material, the first cut having a first length that is less than half the width of the packaging material, and may cause a second cut to be formed along the width of the packaging material, the second cut having the first length that is less than half the width of the packaging material. The first side 510 and the second side 520, respectively, may then be folded. The packaging material may remain coupled to an adjacent portion of packaging material via a portion of the packaging material between the first cut and the second cut, and another item may be disposed on the adjacent portion of packaging material, so as to form a continuous packing process.

One or more computer systems may be in communication with a sensor system to determine whether the item is positioned in a first position on the packaging material that exceeds a predetermined boundary. If so, the computer system may cause the item to be repositioned from the first position to a second position within the predetermined boundary using a robotic arm prior to applying the adhesive and/or initiating folding of the sides.

At a second instance 530, a first gusset 540 and a second gusset 550 may be formed as the sides 510, 520 are folded. Depending on the configuration of the package, the gussets may be folded inward-facing or outward-facing, as discussed with respect to FIG. 7. The crease lines and/or patterns may increase a flexibility of the sides of the package.

At a third instance 560, the package may be formed, and edges 570, 590 of the package may be pressed to seal the package. The pressed edges may be separated from the roll of packaging material with a third cut to separate the sealed package from the roll of packaging material.

At a fourth instance 580, the sealed package with the item inside may be completed and transferred to a takeaway conveyor for downstream processing. The item may be securely packed in the custom sized package, and there may not be any scraps or wasted material.

Figure 6:
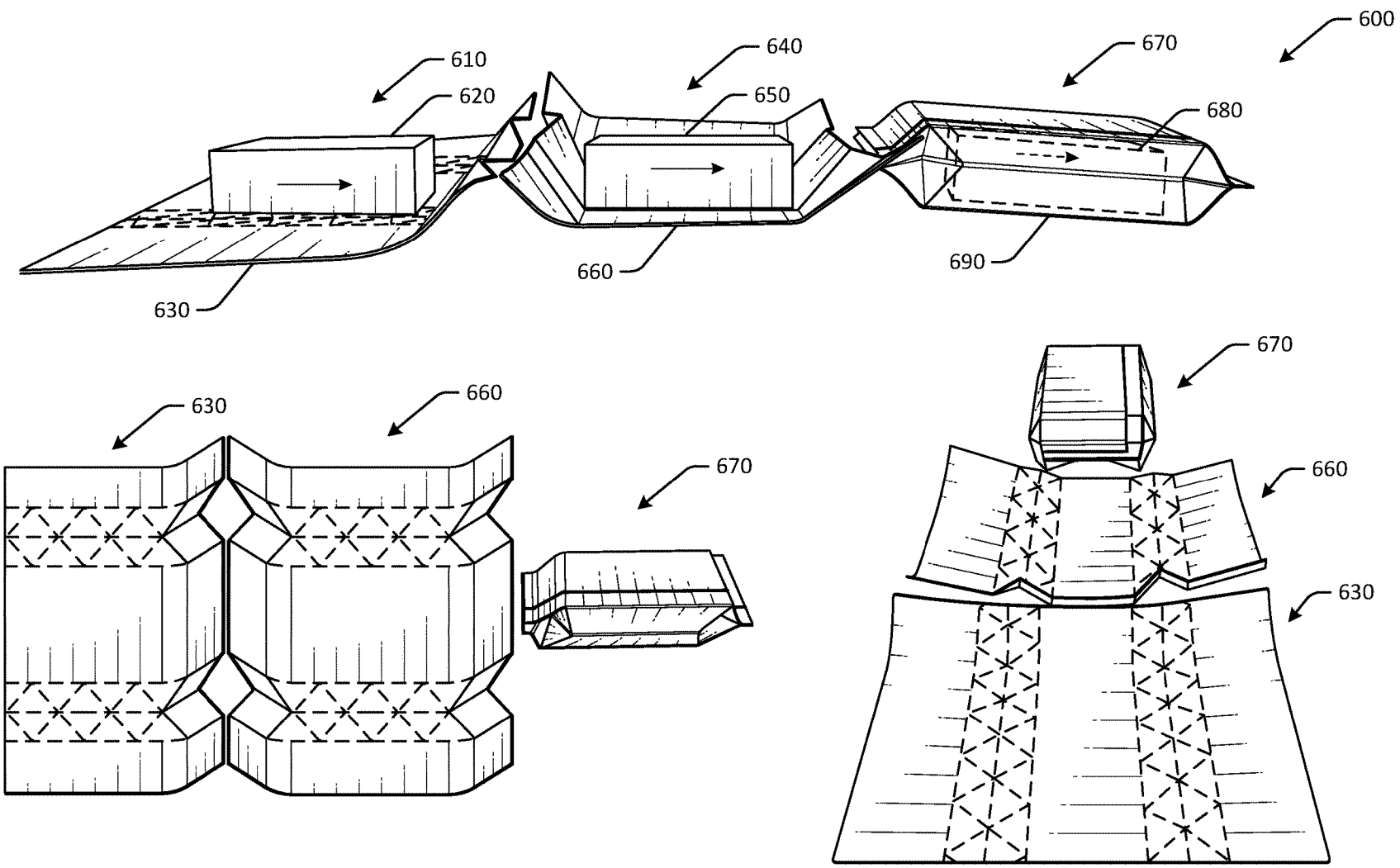
FIG. 6 is a schematic illustration of an example roll-formed container formation process in various views in accordance with one or more embodiments of the disclosure.

FIG. 6 is a schematic illustration of an example custom sized roll-formed container formation process 600 in various views in accordance with one or more embodiments of the disclosure. Other embodiments may include additional or fewer components. The illustration of FIG. 6 may not be to scale, and may not be illustrated to scale with respect to other figures. The illustrated process of continuous packing may be implemented by any of the systems described with respect to FIGS. 1-5.

In FIG. 6, the custom sized roll-formed container formation process 600 depicts a number of items disposed on adjacent portions of packaging material for sequential packaging. For example, a roll of packaging material may be unrolled to provide packaging material for packing a first item 680, a second item 650, a third item 620, and so forth. As the first item 680 is packed into a sealed container during a sealing process 670 of the packaging material 690, the packaging material 660 of the second item 650 may be folded during a folding process 640, and cuts may be made to the packaging material 630 of the first item 620 during a cutting process 610. As the system flows from left to right in the example of FIG. 1, a continuous number of items can be packed at various stages of packing.

The packages in different stages of formation may remain connected as each item progresses through the system, until a package is formed and separated from the adjacent packaging material with a final cut through the packaging material. For example, the packaging material may have a width, and a first cut may be formed along the width of the packaging material, where the first cut has a first length that is less than half the width of the packaging material. A second cut may be formed along the width of the packaging material, the second cut having the first length that is less than half the width of the packaging material. The cuts may facilitate folding of the sides of the package. The packaging material may remain coupled to an adjacent portion of packaging material via a portion of the packaging material between the first cut and the second cut, and a second item may disposed on the adjacent portion of packaging material. Once a package is formed, a third cut may be formed across the portion of the packaging material between the first cut and the second cut to separate the packaging material from the adjacent portion of packaging material. In some embodiments, the packaging material may have a rectangular shape, and a glue or other adhesive may be applied along a number of edges or sides of the packaging material, such as about three edges of the packaging material.

Figure 7:
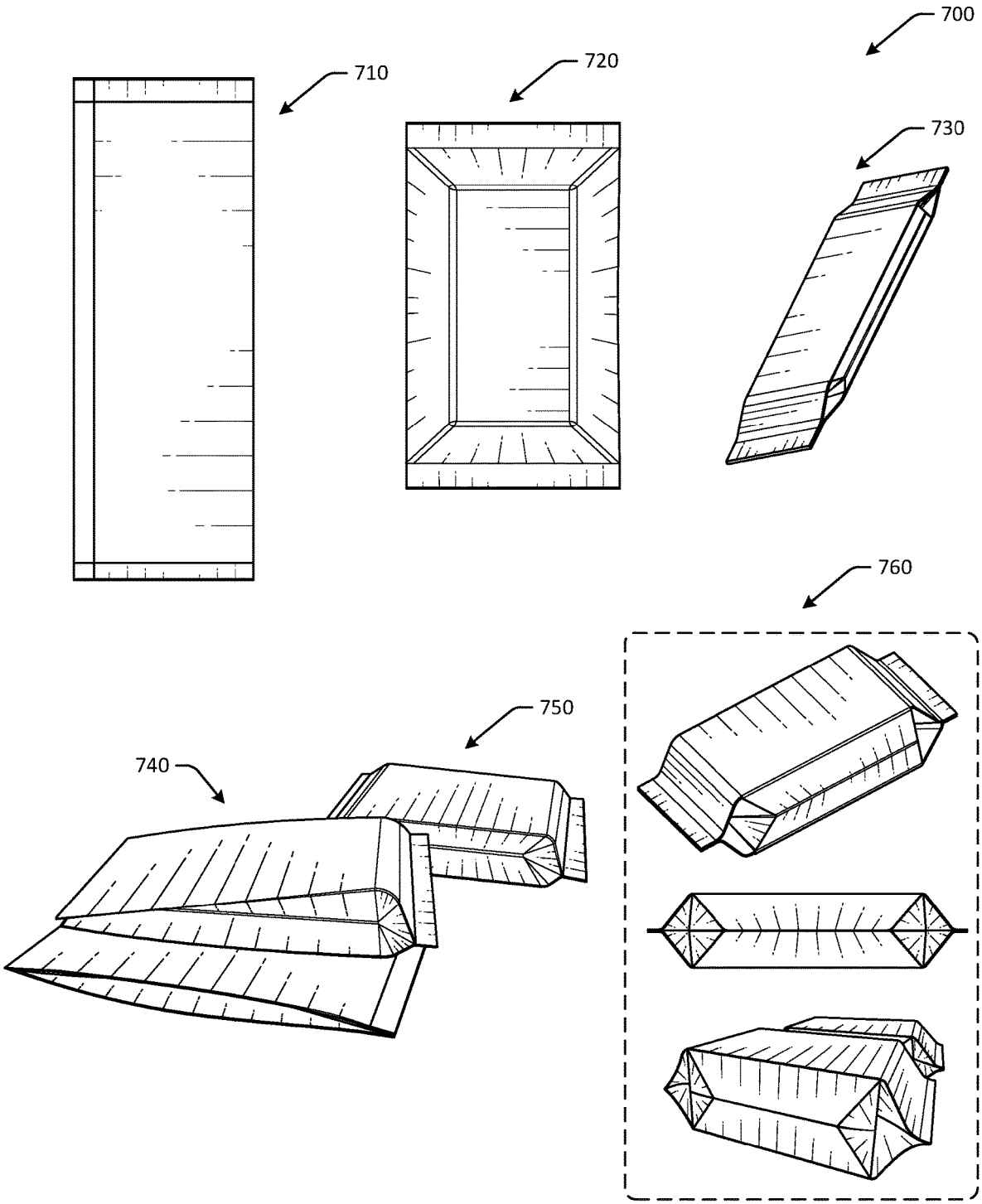
FIG. 7 is a schematic illustration of various roll-formed containers in accordance with one or more embodiments of the disclosure.

FIG. 7 is a schematic illustration of various custom sized roll-formed containers 700 in accordance with one or more embodiments of the disclosure. Other embodiments may include additional or fewer components. The illustration of FIG. 7 is for illustrative purposes only. Any number of different configurations of packages can be formed using the same packaging material and same item packing systems described with respect to FIGS. 1-6.

The systems and methods described herein may be used to produce any number of package configurations, such as those illustrated in FIG. 7. For example, a first package type 710 may be a long, flat package with outward-facing or outward-folded gussets. The first package type 710 may be formed by a single crease line along both sides of the package. The first package type 710 may not include any tessellations or patterning along side crease lines in some embodiments.

A second package type 720 may be a rectangular package with outward-facing gussets and trapezoidal crease lines to form a package with a raised center portion when sealed. A third package type 730 maybe similar to the second package type 720 but with inward-facing gussets to form flexible sidewalls that can be compressed with resiliency to return to an original height. A fourth package type 740 may form a bag-like container where a lower portion of the container has a greater height than an upper portion of the container. A fifth package type 750 may also be a bag-like container that includes crease lines across the width of the package to provide improved flexibility along the upper and lower walls of the package, in addition to the sidewalls.

A sixth package type 760 is depicted in a number of views and may include a package having inward-facing gussets and forms a package with resilient sidewalls. The sixth package type 760, or any of the other package types, may therefore be a container that includes a rectangular sheet of roll-formed and non-Gaussian material. The container(s) may include a first crease line, a second crease line separated from the second crease line by a distance, an optional first crease pattern disposed adjacent to the first crease line, and an optional second crease pattern disposed adjacent to the second crease line. The container may include an adhesive, such as a hot melt spray, disposed about three sides of the rectangular sheet. In some embodiments, the container may include inward-facing gussets to increase a thickness of the container, or outward-facing gussets to reduce a thickness of the container. A first dimension of the first crease pattern and the second crease pattern may correspond to a second dimension of the item, such as a height of the item. The first crease pattern may be any suitable pattern, such as a triangular pattern or a diamond pattern. The roll-formed or other non-Gaussian material may return to a substantially flat sheet when unsealed. For example, if the packages of FIG. 7 are opened and unsealed along the adhesive, the packages may return to a substantially flat sheet of material over time.

One or more operations of the methods, process flows, or use cases of FIGS. 1-7 may have been described above as being performed by a user device, or more specifically, by one or more program module(s), applications, or the like executing on a device. It should be appreciated, however, that any of the operations of the methods, process flows, or use cases of FIGS. 1-7 may be performed, at least in part, in a distributed manner by one or more other devices, or more specifically, by one or more program module(s), applications, or the like executing on such devices. In addition, it should be appreciated that processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-7 may be described in the context of the illustrative devices, it should be appreciated that such operations may be implemented in connection with numerous other device configurations.

The operations described and depicted in the illustrative methods, process flows, and use cases of FIGS. 1-7 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-7 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by the execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Illustrative Computer Architecture

Figure 8:
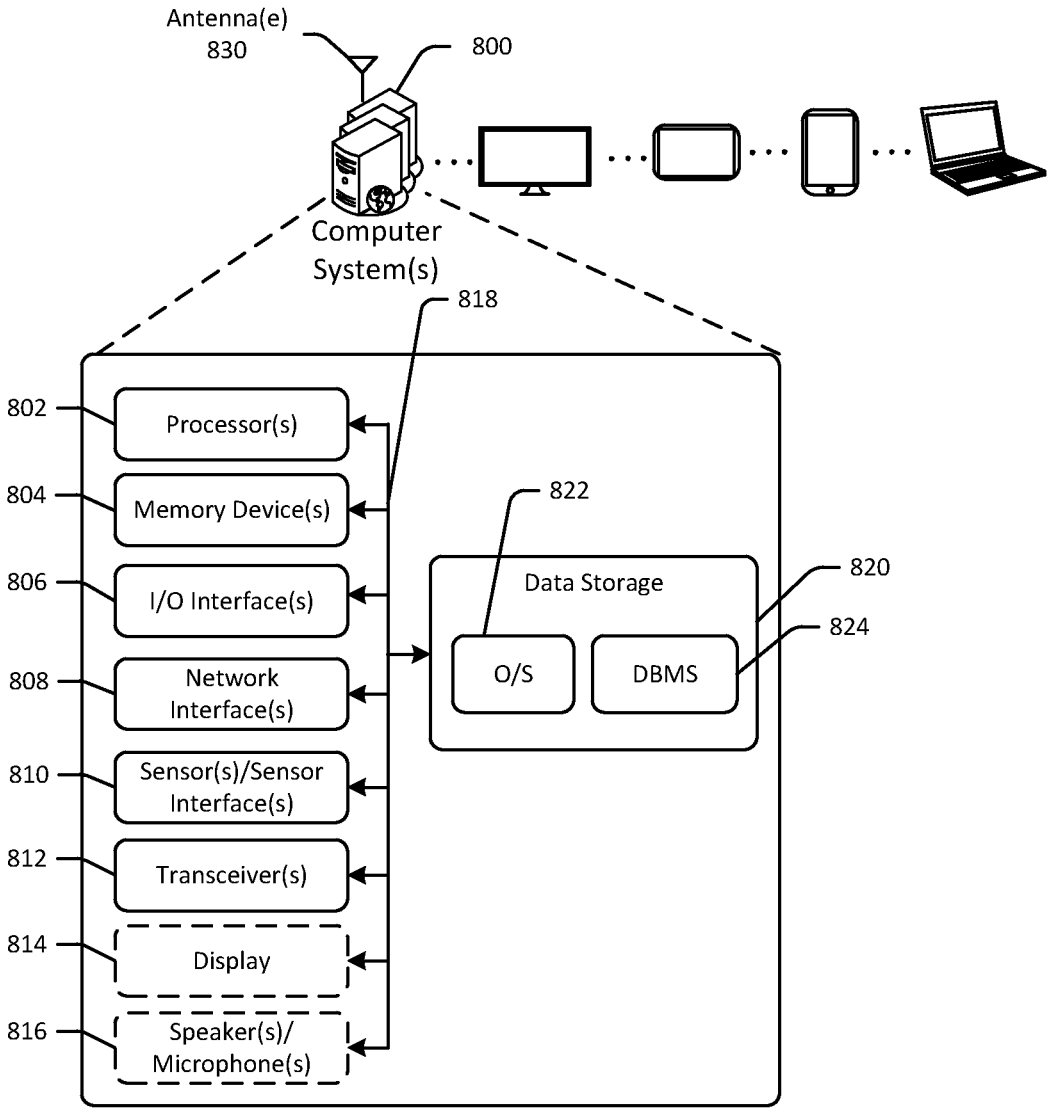
FIG. 8 schematically illustrates an example architecture of a computer system associated with a custom sized roll-formed container generation system in accordance with one or more embodiments of the disclosure.

FIG. 8 is a schematic block diagram of one or more illustrative computer system(s) 800 in accordance with one or more example embodiments of the disclosure. The computer system(s) 800 may include any suitable computing device including, but not limited to, a server system, a voice interaction device, a mobile device such as a smartphone, a tablet, an e-reader, a wearable device, or the like; a desktop computer; a laptop computer; a content streaming device; or the like. The computer system(s) 800 may correspond to an illustrative device configuration for the device(s) of FIGS. 1-7. For example, the computer system(s) 800 may control one or more aspects of the custom sized roll-formed container systems described in FIGS. 1-7.

The computer system(s) 800 may be configured to communicate with one or more servers, user devices, or the like. The computer system(s) 800 may be configured to identify items, detect positioning of items, control container formation machine operations, and so forth.

The computer system(s) 800 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computer system(s) 800 may include one or more processors (processor(s)) 802, one or more memory devices 804 (also referred to herein as memory 804), one or more input/output (I/O) interface(s) 806, one or more network interface(s) 808, one or more sensor(s) or sensor interface(s) 810, one or more transceiver(s) 812, one or more optional display(s) 814, one or more optional microphone(s) 816, and data storage 820. The computer system(s) 800 may further include one or more bus(es) 818 that functionally couple various components of the computer system(s) 800. The computer system(s) 800 may further include one or more antenna(s) 830 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 818 may include at least one of a system bus, a memory bus, an address bus, or a message bus, and may permit the exchange of information (e.g., data (including computer-executable code), signaling, etc.) between various components of the computer system(s) 800. The bus(es) 818 may include, without limitation, a memory bus or a memory controller, a peripheral bus, an accelerated graphics port, and so forth. The bus(es) 818 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 804 of the computer system(s) 800 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 804 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 804 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 820 may include removable storage and/or non-removable storage including, but not limited to, magnetic storage, optical disk storage, and/or tape storage. The data storage 820 may provide non-volatile storage of computer-executable instructions and other data. The memory 804 and the data storage 820, removable and/or non-removable, are examples of computer-readable storage media (CRSM) as that term is used herein.

The data storage 820 may store computer-executable code, instructions, or the like that may be loadable into the memory 804 and executable by the processor(s) 802 to cause the processor(s) 802 to perform or initiate various operations. The data storage 820 may additionally store data that may be copied to the memory 804 for use by the processor(s) 802 during the execution of the computer-executable instructions. Moreover, output data generated as a result of execution of the computer-executable instructions by the processor(s) 802 may be stored initially in the memory 804, and may ultimately be copied to the data storage 820 for non-volatile storage.

More specifically, the data storage 820 may store one or more operating systems (O/S) 822; one or more database management systems (DBMS) 824; and one or more program module(s), applications, engines, computer-executable code, scripts, or the like. Some or all of these module(s) may be sub-module(s). Any of the components depicted as being stored in the data storage 820 may include any combination of software, firmware, and/or hardware. The software and/or firmware may include computer-executable code, instructions, or the like that may be loaded into the memory 804 for execution by one or more of the processor(s) 802. Any of the components depicted as being stored in the data storage 820 may support functionality described in reference to corresponding components named earlier in this disclosure.

The data storage 820 may further store various types of data utilized by the components of the computer system(s) 800. Any data stored in the data storage 820 may be loaded into the memory 804 for use by the processor(s) 802 in executing computer-executable code. In addition, any data depicted as being stored in the data storage 820 may potentially be stored in one or more datastore(s) and may be accessed via the DBMS 824 and loaded in the memory 804 for use by the processor(s) 802 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 802 may be configured to access the memory 804 and execute the computer-executable instructions loaded therein. For example, the processor(s) 802 may be configured to execute the computer-executable instructions of the various program module(s), applications, engines, or the like of the computer system(s) 800 to cause or facilitate various operations to be performed in accordance with one or more embodiments of the disclosure. The processor(s) 802 may include any suitable processing unit capable of accepting data as input, processing the input data in accordance with stored computer-executable instructions, and generating output data. The processor(s) 802 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 802 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 802 may be capable of supporting any of a variety of instruction sets.

Referring now to other illustrative components depicted as being stored in the data storage 820, the O/S 822 may be loaded from the data storage 820 into the memory 804 and may provide an interface between other application software executing on the computer system(s) 800 and the hardware resources of the computer system(s) 800. More specifically, the O/S 822 may include a set of computer-executable instructions for managing the hardware resources of the computer system(s) 800 and for providing common services to other application programs (e.g., managing memory allocation among various application programs). In certain example embodiments, the O/S 822 may control execution of the other program module(s). The O/S 822 may include any operating system now known or which may be developed in the future including, but not limited to, any server operating system, any mainframe operating system, or any other proprietary or non-proprietary operating system.

The DBMS 824 may be loaded into the memory 804 and may support functionality for accessing, retrieving, storing, and/or manipulating data stored in the memory 804 and/or data stored in the data storage 820. The DBMS 824 may use any of a variety of database models (e.g., relational model, object model, etc.) and may support any of a variety of query languages. The DBMS 824 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computer system(s) 800 is a mobile device, the DBMS 824 may be any suitable lightweight DBMS optimized for performance on a mobile device.

Referring now to other illustrative components of the computer system(s) 800, the input/output (I/O) interface(s) 806 may facilitate the receipt of input information by the computer system(s) 800 from one or more I/O devices as well as the output of information from the computer system(s) 800 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computer system(s) 800 or may be separate. The I/O devices may further include, for example, any number of peripheral devices such as data storage devices, printing devices, and so forth.

The I/O interface(s) 806 may also include an interface for an external peripheral device connection such as universal serial bus (USB), FireWire, Thunderbolt, Ethernet port or other connection protocol that may connect to one or more networks. The I/O interface(s) 806 may also include a connection to one or more of the antenna(s) 830 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, a ZigBee network, etc.

The computer system(s) 800 may further include one or more network interface(s) 808 via which the computer system(s) 800 may communicate with any of a variety of other systems, platforms, networks, devices, and so forth. The network interface(s) 808 may enable communication, for example, with one or more wireless routers, one or more host servers, one or more web servers, and the like via one or more networks.

The antenna(s) 830 may include any suitable type of antenna depending, for example, on the communications protocols used to transmit or receive signals via the antenna(s) 830. Non-limiting examples of suitable antennas may include directional antennas, non-directional antennas, dipole antennas, folded dipole antennas, patch antennas, multiple-input multiple-output (MIMO) antennas, or the like. The antenna(s) 830 may be communicatively coupled to one or more transceivers 812 or radio components to which or from which signals may be transmitted or received.

As previously described, the antenna(s) 830 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 830 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g, 802.11n), 5 GHz channels (e.g., 802.11n, 802.11ac), or 60 GHz channels (e.g., 802.11ad). In alternative example embodiments, the antenna(s) 830 may be configured to transmit or receive radio frequency signals within any suitable frequency range forming part of the unlicensed portion of the radio spectrum.

The antenna(s) 830 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 812 may include any suitable radio component(s) for—in cooperation with the antenna(s) 830—transmitting or receiving radio frequency (RF) signals in the bandwidth and/or channels corresponding to the communications protocols utilized by the computer system(s) 800 to communicate with other devices. The transceiver(s) 812 may include hardware, software, and/or firmware for modulating, transmitting, or receiving—potentially in cooperation with any of antenna(s) 830—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 812 may further include hardware, firmware, or software for receiving GNSS signals. The transceiver(s) 812 may include any known receiver and baseband suitable for communicating via the communications protocols utilized by the computer system(s) 800. The transceiver(s) 812 may further include a low noise amplifier (LNA), additional signal amplifiers, an analog-to-digital (A/D) converter, one or more buffers, a digital baseband, or the like.

The sensor(s)/sensor interface(s) 810 may include or may be capable of interfacing with any suitable type of sensing device such as, for example, inertial sensors, force sensors, thermal sensors, photocells, and so forth. Example types of inertial sensors may include accelerometers (e.g., MEMS-based accelerometers), gyroscopes, and so forth.

The optional display(s) 814 may be configured to output light and/or render content. The optional speaker(s)/microphone(s) 816 may be any device configured to receive analog sound input or voice data.

It should be appreciated that the program module(s), applications, computer-executable instructions, code, or the like depicted in FIG. 8 as being stored in the data storage 820 are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the computer system(s) 800, and/or hosted on other computing device(s) accessible via one or more networks, may be provided to support functionality provided by the program module(s), applications, or computer-executable code depicted in FIG. 8 and/or additional or alternate functionality. Further, functionality may be modularized differently such that processing described as being supported collectively by the collection of program module(s) depicted in FIG. 8 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIG. 8 may be implemented, at least partially, in hardware and/or firmware across any number of devices.

It should further be appreciated that the computer system(s) 800 may include alternate and/or additional hardware, software, or firmware components beyond those described or depicted without departing from the scope of the disclosure. More particularly, it should be appreciated that software, firmware, or hardware components depicted as forming part of the computer system(s) 800 are merely illustrative and that some components may not be present or additional components may be provided in various embodiments. While various illustrative program module(s) have been depicted and described as software module(s) stored in the data storage 820, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

One or more operations of the methods, process flows, and use cases of FIGS. 1-7 may be performed by a device having the illustrative configuration depicted in FIG. 8, or more specifically, by one or more engines, program module(s), applications, or the like executable on such a device. It should be appreciated, however, that such operations may be implemented in connection with numerous other device configurations.

The operations described and depicted in the illustrative methods and process flows of any of FIGS. 1-7 may be carried out or performed in any suitable order as desired in various example embodiments of the disclosure. Additionally, in certain example embodiments, at least a portion of the operations may be carried out in parallel. Furthermore, in certain example embodiments, less, more, or different operations than those depicted in FIGS. 1-7 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. A container for an item comprising:
a rectangular sheet of formable material comprising:
a first crease line;
a second crease line separated from the second crease line by a distance;
a first crease pattern disposed adjacent to the first crease line; and
a second crease pattern disposed adjacent to the second crease line; and
a sealant disposed about three sides of the rectangular sheet;
wherein a first dimension of the first crease pattern and the second crease pattern correspond to a second dimension of the item.

2. The container of claim 1, wherein the container comprises inward-facing gussets to increase a thickness of the container.

3. The container of claim 1, wherein the container comprises outward-facing gussets to reduce a thickness of the container.

4. The container of claim 1, wherein the first crease pattern comprises a triangular pattern or a diamond pattern.

5. The container of claim 1, wherein the formable material returns to a substantially flat sheet when the container is unsealed.

6. The container of claim 1, wherein the formable material is a corrugate cardboard material.

7. The container of claim 1, wherein the container forms a self-contained package with the item.

8. A container for an item comprising:
a rectangular sheet of material comprising:
a first crease line;
a second crease line separated from the second crease line by a distance;
a first crease pattern disposed adjacent to the first crease line; and
a second crease pattern disposed adjacent to the second crease line; and
an adhesive disposed about at least two sides of the rectangular sheet;
wherein a first dimension of the first crease pattern and the second crease pattern correspond to a second dimension of the item; and
wherein the container comprises (i) inward-facing gussets to increase a first thickness of a first side of the container, and (ii) outward-facing gussets to reduce a second thickness of a second side of the container.

9. The container of claim 8, wherein the material returns to a substantially flat sheet when the container is unsealed, and wherein the material is a corrugate cardboard material.

* * * * *